United States Patent [19]

Crosnier et al.

[11] Patent Number: 4,458,245

[45] Date of Patent: Jul. 3, 1984

[54] METHOD AND APPARATUS FOR EXPLORING EARTH AND ROCKY FORMATIONS

[75] Inventors: Bernard Crosnier, Montpellier, Pierre Duruisseard, Nimes; Gilles Fras, St. Mathieu de Treviers; Paul Jouanna, Montpellier; Jean-Luc Portales, Lunel, all of France

[73] Assignee: Agence Nationale de Valorisation de la Recherche (ANVAR), Paris, France

[21] Appl. No.: 194,221

[22] Filed: Oct. 6, 1980

[30] Foreign Application Priority Data

Oct. 11, 1979 [FR] France ..... 79 25285

[51] Int. Cl.[3] ..... E21B 41/00

[52] U.S. Cl. ..... 340/853; 367/35; 166/250; 73/151; 73/155; 181/105

[58] Field of Search ..... 181/102, 105, 113, 106, 181/119; 367/17, 18, 101, 189, 49, 35; 166/250, 254, 255; 73/151, 152, 155; 340/853; 175/48, 50

[56] References Cited

U.S. PATENT DOCUMENTS 3,602,308 8/1971 Vincent ..... 166/308 X
3,718,205 2/1973 Fair et al. ..... 367/189
4,044,828 8/1977 Jones et al. ..... 166/308 X

OTHER PUBLICATIONS

"Analysis of Short-Time, Transient Test Data by Type-Curve Matching", Earlougher, Jr. et al., Journal of Petroleum Technology, vol. 26, Jul. 1974, pp. 793-800.

*Primary Examiner*—Maynard R. Wilbur
*Assistant Examiner*—K. R. Kaiser
*Attorney, Agent, or Firm*—Brisebois & Kruger

[57] ABSTRACT

The length and width of fissures in a bore hole is determined by alternately flowing liquid into and out of the formation from an isolated zone of a bore hole, at different frequencies, and measuring the dynamic pressure of the flowing fluid. The length of fissures in the isolated zone is determined from frequency peaks at high pressure to flow ratios, and the thickness of the fissures is determined from variations of pressure-flow ratios with frequency by comparison with known data. Sonde apparatus for practicing the method is also disclosed.

11 Claims, 3 Drawing Figures

Figure 1:
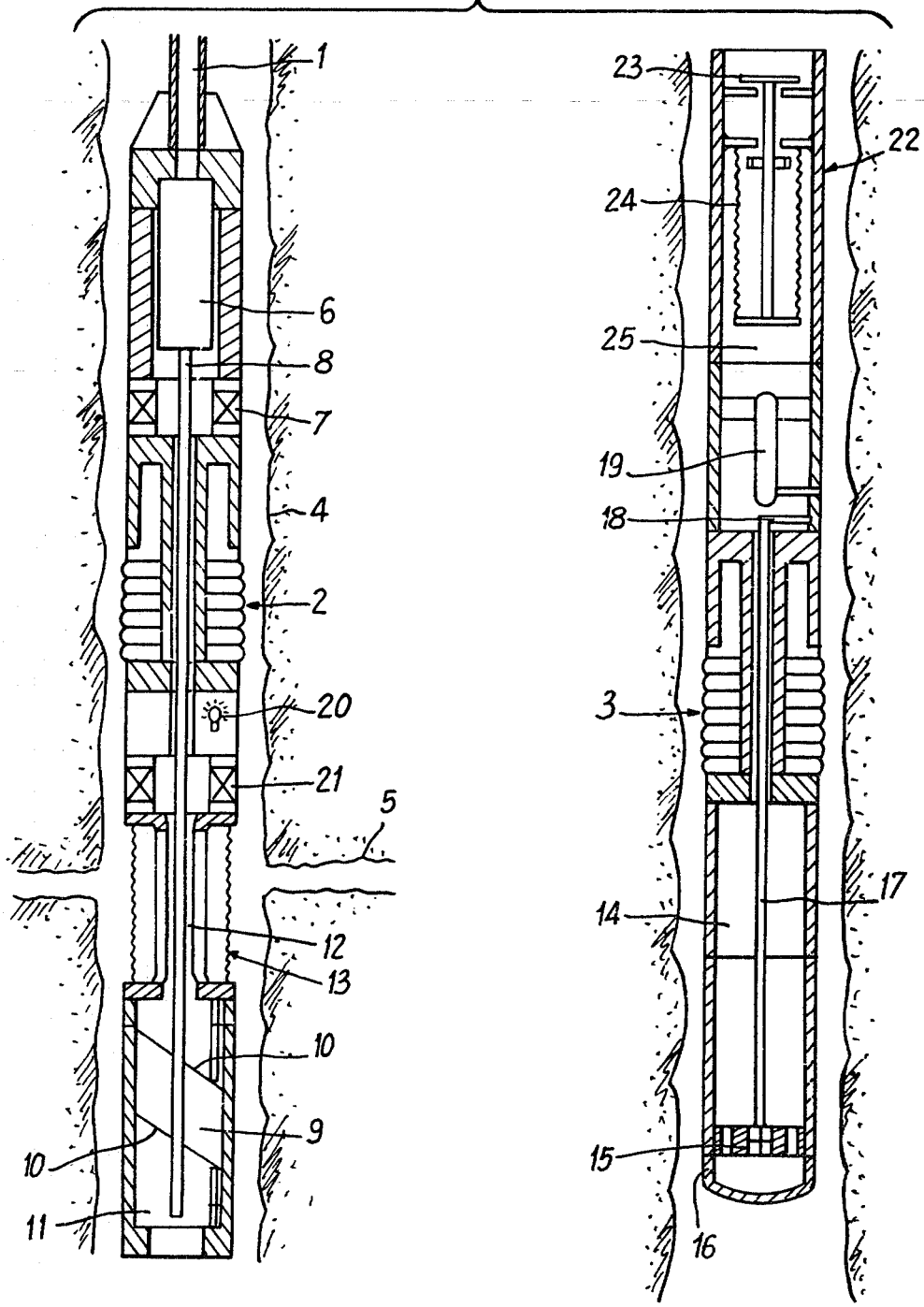

= 0,165 m
= 300m
= 1401 M.S
= 1000 KG/M3
ρ|c
10^9
10^8
10^7
10^6
10^5
10^4
2,84
0,5mm
2mm
3mm
0,
0,5
1,0
1,5
2,0
2,5
3,0
(HZ)

= 0,165 m
= 1mm
=1401 M,S
=1000 KG,M3
3,78
4,86
6,93
225 m
175 m
10^10
10^9
10^8
10^7
10^6
10^5
0
1
2
3
4
5
6
7
(HZ)

METHOD AND APPARATUS FOR EXPLORING EARTH AND ROCKY FORMATIONS

The present invention relates to a method and apparatus for exploring earth and rocky formations. Rational exploitation of natural underground resources requires a precise evaluation of the exploitable resources. Thus in the field of hydrogeology and in the search for and exploitation of petroleum it is necessary to have very exact knowledge of the geological, geometrical and hydraulic characteristics of subterranean reservoirs. This concern also exists for geotechnicians who in order to predict the hydromechanical behavior of rocky formations traversed by flowing water must make use of a thorough description of the geometrical, hydraulic and mechanical parameters. Other systems notably geothermics and the storage of materials such as radioactive materials in massive subterranean rock formations, of which the development is recent, also require such information to work out predictable patterns.

While the systems differ in their objectives and their technologies, they all have in one phase of their activity, the same problems of determining the parameters to introduce into the predicting or prospecting model.

Drainage in a fissured region, at first interpreted by the classic forms of a porous region characterized by a distribution of porosity and permeability, are currently the object of models or patterns in which discontinuities are taken into account. This so-called analytical description considers the rocky region as a homogenous continuous material separated by free discontinuities called fissures or crevices.

Very difficult technological procedures are at the disposal of the technician to obtain information about the rocky region which he is studying. The modern procedures of structural geology associated with geophysical measurements permit precise determination of the interior geometry of the formation. The hydraulic parameters are generally determined by pumping or injection tests by transitory or pseudo-permanent operations.

The process of analyzing geological structures consists of effecting a systematic survey of the fractures in the zones of interest by a drainage or flow study. This survey is carried out in part by the observations of soundings, in shafts or bores, or on the outcroppings.

The geophysical techniques consist in the application to the rocks of the important general laws of physics. By measurement one determines the values, for the rocky formations studied, of the parameters associated with these laws (electrical resistance, magnetic characteristics, radioactivity, speed of sound, heat conductivity. . .). By the interpretation of these parameters one is able to obtain information on the region studied such as the nature and position of layers, fracture patterns, porosity,. . . One also knows of gravimetric procedures, electrical procedures, magnetic and electro-magnetic procedures, seismic prospecting procedures, radioactive procedures and thermometric procedures. These known procedures are described in detail in the book: "Geophysics applied to hydrology" by Mr. J. L. ASTTER published by Masson in 1967.

The hydraulic procedures consist essentially of pumping or injection tests in the cased or uncased bore holes and partial straining.

The procedures associated with the techniques of tests such as for example the Lugeon test, the utilization of a sonde called triple hydraulic, or the utilization of a piezofor or of a piezopermeometer, are procedures the interpretation of which are reported in a report published by the International Society of the Mechanics of Rocks in August, 1977, and entitled "Suggested Method for Determining Hydraulic Parameters and Characteristics of Rock Formations". These interpretation procedures may be classified as permanent or pseudo-permanent models which permit a determination of the overall or localized permeability, and as transient models which permit the interpretation of measurements in the fissured region by simple geometry and where the scale of fissuring is small with respect to the site of the test.

From the interpretations of the tests by these different procedures one derives very uncertain information of the fissured rocky formations. In effect, this information is derived most often by the determination of the local permeability which it is difficult to relate to the analytical parameter of the fissuring of the formation. For example, the extent of the fissures or the fractures is a parameter particularly difficult to estimate.

The present application proposes a process and an apparatus to prospect rocky formations and earth to permit obtaining spectral signatures of the explored zones, and permitting by interpretation of the results obtained, qualitative and quantitative determinations of the parameters of the formations studied, notably the dimensions of the fissures.

The procedure according to the invention is characterized essentially by the fact that one isolates a predetermined zone of a bore hole, that one causes in the zone of the bore an alternating flow of the fluid located in the bore between the bore and the surrounding formation, according to a predetermined function, perferably sinusoidal, that one balances so as to compensate for it, the static pressure in the zone, that one varies the frequency of the flow function according to a range of frequency values, that one measures for each of the frequency values the dynamic pressure generated in the zone of the bore by the alternating flow of fluid, and that one compares the variations with respect to reference models, especially mathematical, the variations as a function of the said frequency, of the relation of the modules of the function of dynamic pressure and of flow.

The procedure according to the invention thus consists of studying a system which in the case of a test with water in a fissured formation may be considered as being the formation in two phases, solid and water, in which is placed a testing device. One causes in this system an exitation or input signal which in the present case is the alternating flow, the response of the system being provided by the detection and measurement of the dynamic pressure caused by this excitation, the dynamic pressure being after establishment of a stationary condition, a sinusoidal function like the excitation flow function.

The procedure according to the invention aims to provide spectral signatures of the areas studied, these spectral signatures being the variations as a function of the frequency of the transfer function modules of the system, a good approximation of this transfer function modulus being given by the relation of the created dynamic pressure function modulus and the alternating flow of fluid.

It is remarkable, as will be seen hereafter, that a fissure in a rocky formation behaves with respect to an excitation as a resonator, the frequency of resonance being characteristic of the length of the fissure.

The measurement area can advantageously be isolated, in a known manner, by means of inflatable obturators or packers, controlled hydraulically from the surface.

The alternating sinusoidal flow can advantageously be caused by alternating displacements of a membrane, particularly in the form of metallic bellows, constituting a portion of the external tubular wall of a sonde introduced into the bore hole.

In one particular embodiment, the alternating movement of this membrane can be caused by an alternatng to and fro movement in a chamber, of a piston connected to a shaft driven in continuous rotation by a turbine.

The embodiment is particularly advantageous in measurements in which the flow function modulus is then for a piston of determined characteristics directly proportional to the frequency of rotation of the turbine which is easy to measure. By measurement of this frequency of rotation and by an appropriate calibration one knows directly the modulus of the flow function, that is in fact, the mean amplitude of the flow caused in the fluid in a stationary sinusoidal condition.

The device according to the invention is characterized essentially by the fact that it includes a sonde able to be lowered into a bore hole at the end of a drill string this sonde having inflatable plugs able to press against the walls of the bore hole by being supplied with hydraulic fluid from the surface, and defining between them an isolated measurement zone, the sonde having means to cause from its periphery an alternating flow of the fluid in the bore hole between this latter and the surrounding formation, particularly a chamber in which is moveable a piston to and fro, the piston being connected to a shaft driven in rotation by means of a turbine, the chamber being in communication with a chamber whose external wall is an annular membrane, preferably a metallic bellows, the sonde also having a mechanism of counter-pressure to balance and compensate for the static pressure sensor in the zone of measurement, a pressure sensor in the measurement zone of the bore hole, and connecting means between the sonde and the surface to direct the various control fluids and relay the information supplied by the pressure sensor.

Advantageously, the piston has a cylindrical shape with end faces which are bevelled and is guided in the chamber in such a manner that the continuous movement in rotation of the shaft of the turbine is transformed into alternating to and fro movement of the piston.

The speed of rotation of the shaft can advantageously be controlled by photoelectric means placed in the sonde.

The counter-pressure mechanism advantageously has at the lower portion of the sonde a reservoir of compressed gas at a pressure at least equal to the static pressure at the maximum depth to which it is desired to lower the sonde, an opening in the lower portion of the sonde, isolated from the reservoir by a check valve, a capillary connection being realized between the check valve and a point on the periphery of the sonde, in the measurement zone between the inflatable plugs.

Figure 2:
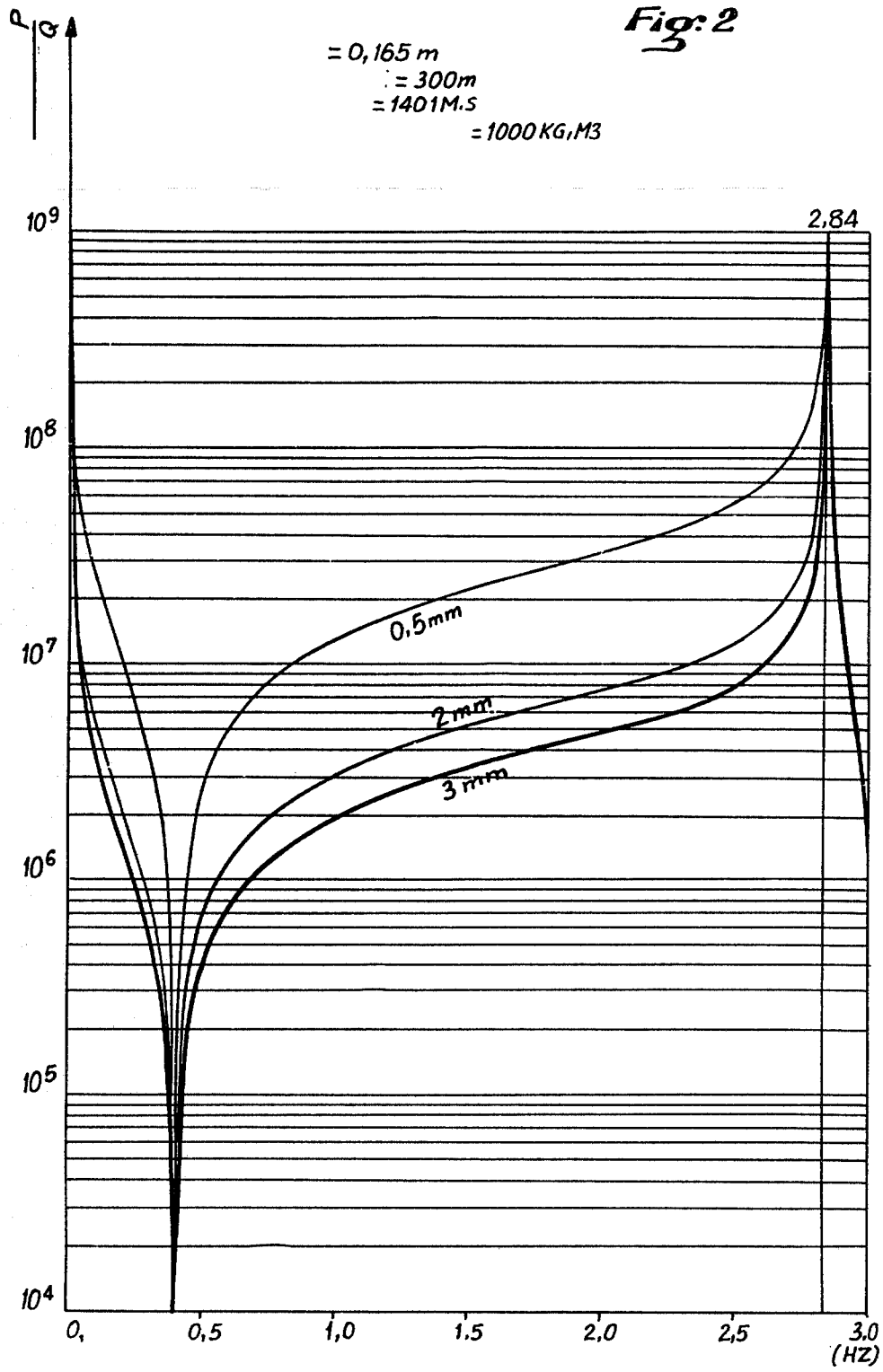
Figure 3:
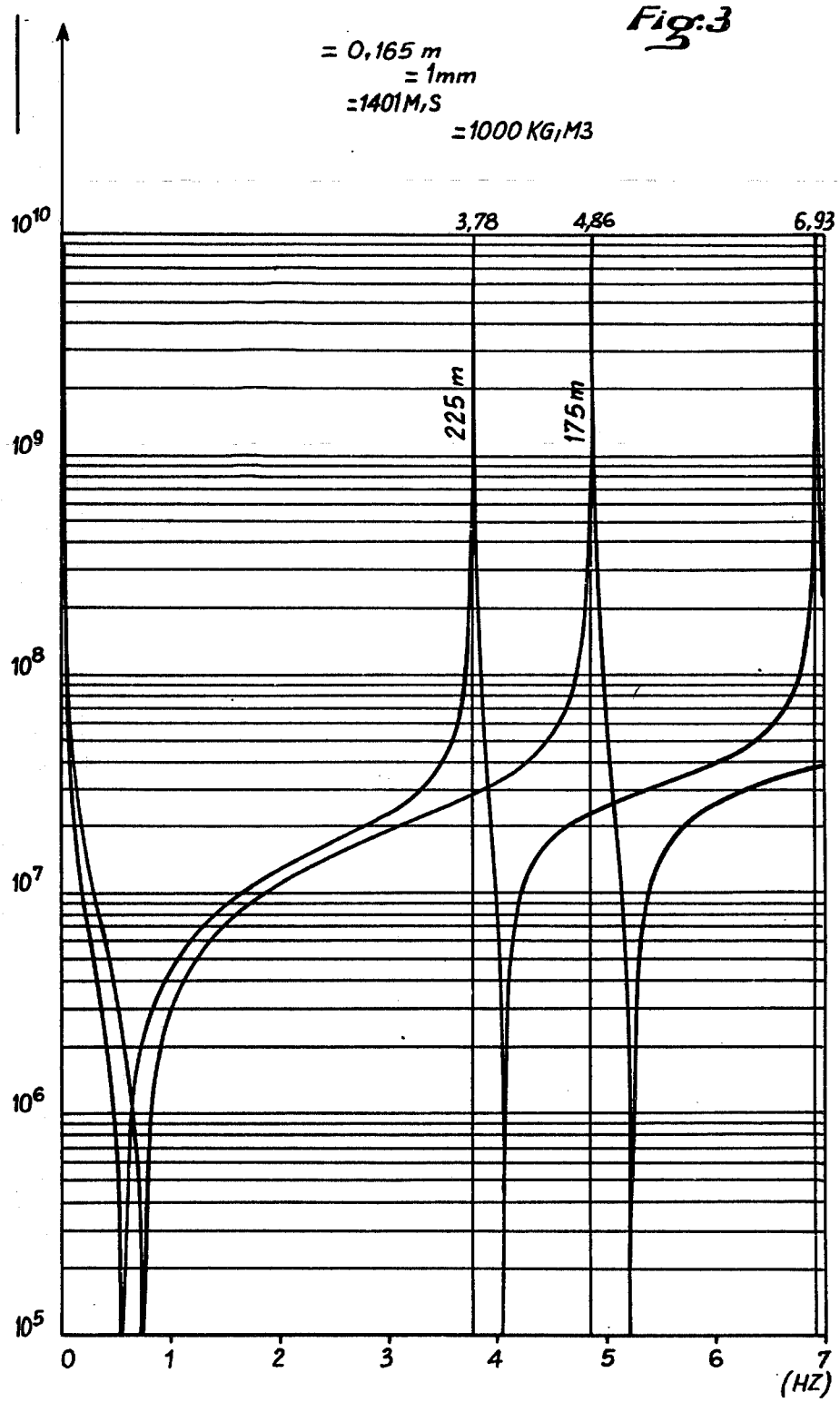

Other advantages and characteristics of the invention will become apparent on reading the following description of one non-limiting exemplary embodiment, referring to the accompanying drawings in which:

FIG. 1 shows very schematically a device according to the invention in place in a bore hole, the left side of the figure showing the upper portion of the device which is joined to the lower portion shown on the right side of the figure; and FIGS. 2 and 3 are graphs of examples of spectral signatures of fissures of different dimensions.

The device according to the invention shown on FIG. 1 takes the form of an elongated sonde able to be attached to the lower portion of a drill string 1 having hydraulic and electrical connection lines to supply the different energies necessary for the functioning of the sonde and to transmit the information collected to the surface.

The sonde has an upper inflatable plug 2 and a lower inflatable plug 3, commonly called packers and able to be inflated from the surface by a flow of hydraulic fluid so as to press against the walls of the bore hole 4.

After inflation of the plugs there is then defined between them an isolated measurement zone in the interior of which is shown schematically a fissure or fracture 5.

The device according to the invention includes a turbine 6 of the hydraulic drilling turbine type, whose hydraulic drive fluid is evacuated through a check valve 7 above the upper inflatable plug 2.

The output shaft 8 of this turbine 6 is attached to a piston 9 presenting bevelled end surfaces 10 having a slope of up to 60%, the average slope preferably being on the order of 45%. The piston 9 because of the movement in rotation of shaft 8 is thus displaced by a vertical to and fro movement in the chamber 11, preferably filled with oil, in which it is located. The piston is guided in this chamber and its displacements are defined by upper and lower cam rods.

Above chamber 11 and in communication with its oil is a chamber 12 whose peripheral wall is constituted of a membrane in the form of a metal bellows 13. The reciprocating movement of the piston 9 in the chamber 11 by means of the action of rotation of the turbine 6 cause thus pulsating alternating displacements of membrane 13 causing displacement of the fluid surrounding the sonde in the measurement zone, and for each pulsation causing an alternation, a flow of fliud is caused through the bore hole toward fissure 5 and then the fluid returns from fissure 5 into the bore hole at the level of the measurement zone. The arrangement of the piston and of the membrane is preferably such that the function of the flow thus produced is presented in a sinusoidal form.

In one particular embodiment one could use a piston having a cross-section or area of 78.5 $cm^2$ and a stroke of 10 cm for each one half-turn of the shaft, thus the stroke of the piston causes a flow of 785 $cm^3$ of fluid in the fissure per alternation.

At the lower portion of the device according to the invention is located a counter-pressure mechanism permitting compensation and balancing of the static pressure prevailing at the depth at which the sonde is positioned.

The counter-pressure mechanism basically comprises a gas reservoir 14 compressed at a high pressure corresponding to that prevailing at the maximum depth to which the sonde is to be lowered, for example 200 bars, this pressurization taking place at the surface. The mechanism includes in its lower portion a check valve 15 beyond which is an outlet opening 16. A capillary tube 17 ensures a connection between check valve 15 and an opening 18 opening into the bore hole in the measurement zone between the inflatable plugs.

It will be understood that as the sonde is raised in the bore hole to make measurements in different areas a progressive escape of the compressed gas located in the reservoir 14 takes place. The reservoir pressure is thus constantly at equilibrium with the exterior static pressure in the bore hole at the level under consideration.

The device also includes a pressure sensor possibly connected to a temperature sensor.

The dynamic pressure measured by sensor 19 in the form of a sinusoidal signal, after establishment of a stationary condition, at a determined frequency corresponding to the rotation of the turbine, is transmitted toward the surface preferably in the form of a train of variable frequency waves (VCO system).

The device also includes means for controlling the speed of rotation of output shaft 8 of the turbine, shown schematically in the form of a photoelectric cell 20.

The measurement of the frequency of rotation of the output shaft of the turbine furnishes, after appropriate calibration corresponding to the dimensions and the stroke of the piston, the desired value of the modulus of the flow function.

The device also includes in the portion corresponding to the measurement zone a check valve 21 in hydraulic fluid communication with the surface, and permitting if desired, a modification of the opening of the fissures and hydraulic fracturing of the rocky formations.

Finally, it is advantageous to provide in the lower portion of chamber 11 a safety mechanism represented overall by 22 and having flap valves 23 and metal membrane 24 in a chamber 25 containing compressed air.

This safety mechanism eliminates the possibility of damage to the piston 9/membrane 13 assembly at the surface during the filling of reservoir 14 and is equally useful to supply this same protection in the case of accidental excess pressures during use.

To carry out the procedure according to the invention, in a measurement zone, the frequency of rotation of the turbine is varied according to predetermined values and for each frequency one receives a signal corresponding to the dynamic pressure function caused by the alternating sinusoidal flow produced in the surrounding formation.

The resultant curves are compared, showing the relation of the modulus of dynamic pressure to the modulus of the flow as a function of the frequency, to curves obtained from mathematical or experimental models each corresponding to the determined characteristics of fissures or of types of soils.

Thus, FIGS. 2 and 3 represent such curves. In FIG. 2 are shown the spectral signatures for fissures of a length or radius of 300 m from the bore hole and of width of 0.5 mm, 2 mm and 3 mm.

The resonance peak corresponding to a frequency of 2.84 hertz is characteristic of the length of the fissure.

FIG. 3 shows the curves obtained for fissures having a width of 1 mm and respective lengths or extensions of 175 m, with a resonance frequency of 4.86 hertz, and 225 m with a resonance frequency of 3.78 hertz. The third peak shown on FIG. 3 corresponds to the second resonance frequency for the 225 m fissure.

It is sufficient for the interpretation of the results as to the width of the fissure, to consider the shape of the curve before the first resonance peak.

In practice, one will have at one's disposal compilations of spectral signatures, and a comparison of the values obtained by the use of the procedure according to the invention, with the theoretical curves, will supply the desired information.

The example described shows the use of the invention for the quantitative determination of the dimensions of fissures in rocky formations.

It should however be understood that the invention is not limited to such a geologic region and can be applied in numerous fields, particularly hydrogeology and water resources, not only in fissured rocks, but also in porous or Karstic rocks and in earth, in the field of geothermics in moist rocks to deal with questions of geothermic resources, or in the petroleum field whatever the bearing rocks may be. In the same way the invention may be used in the field of deep geothermics in dry rocks, in the field of geotechnics dealing with one or plural borings or with the determination of the characteristics of a region to use for the storage of wastes, particularly radioactive, at great depths.

Finally, although the invention has been described in connection with a particular embodiment of the device, it is of course evident that it is in no way thereby limited and may undergo numerous modifications without exceeding either the spirit or the scope of the invention.

We claim:

1. Process for determining the width and radial length of fissures in earth and rocky formations traversed by a bore hole comprising the steps of, isolating a zone of a predetermined length of the bore hole causing fluid in said isolated zone of the bore hole to flow alternately from the bore hole into and out of the surrounding formation in accordance with a predetermined flow function balancing the static pressure in the isolated zone of the bore hole, varying the frequency of the flow according to a range of frequency values, measuring for each frequency value the dynamic pressure created in the isolated zone of the bore hole by the alternating flow of fluid, and comparing with previously obtained data, variations of dynamic pressure and flow with frequency, to determine the width and radial length of at least one fissure in the isolated zone of the bore hole.

2. Process according to claim 1 wherein said step of causing fluid to flow into and out of the formation comprises alternately displacing a membrane in a wall of a well tool positioned within said isolated zone, the membrane separating the interior of the tool from the formation.

3. Process according to claim 2, further comprising, maintaining a static pressure within the tool equal to the static pressure in the isolated zone.

4. Process according to claim 2, wherein said step of displacing said membrane comprises alternately displacing a fluid within the tool against said membrane.

5. Process according to claim 4 wherein said step of displacing the fluid within the tool comprises displacing the fluid with a piston.

6. Process according to claim 5 further comprising measuring the speed of rotation of a shaft driving the piston to determine the frequency of the alternating flow.

7. Apparatus for determining the dimensions of fissures in a bore hole comprising, a sonde to be lowered into a bore hole, distendable packer means on said sonde for isolating a measurement zone in said bore hole, displaceable means in said sonde for causing fluid in said measurement zone to flow alternately from said measurement zone into and out of the formation surrounding the measurement zone, means for varying the frequency of displacement of said displaceable means to vary the frequency of flow of the fluid, means for measuring the dynamic pressure of the fluid, means for maintaining a static pressure within the sonde equal to the static pressure of fluid in the isolated zone, and means for transmitting measured information to a surface station.

8. Apparatus according to claim 7 wherein said means for causing the alternating flow of fluid includes a chamber filled with liquid, a piston is movable back and forth in said chamber, said piston being connected to a shaft driven in rotation by a turbine, said chamber being in communication with a second chamber whose wall comprises a deflectable external wall of the sonde.

9. Apparatus according to claim 8 wherein said piston comprises a cylindrical piston with bevelled end surfaces, and means in said chamber for driving said piston alternately back and forth in response to rotation of the shaft of the turbine.

10. Device according to claim 8 wherein the speed of rotation of the shaft is controlled by photoelectric means located in the sonde.

11. Device according to claim 7 wherein said static pressure maintaining means comprises, in the lower portion of the sonde, a reservoir of compressed gas at a pressure at least equal to the static pressure at the greatest depth to which the sonde is to be lowered, an opening in the lower portion of the sonde isolated from the reservoir by a check valve, and a capillary connection between said check valve and a point on the periphery of the sonde in the isolated measurement zone between the packer means.

* * * * *